US009534431B2

(12) United States Patent
Gouge et al.

(10) Patent No.: US 9,534,431 B2
(45) Date of Patent: Jan. 3, 2017

(54) METHODS OF INSTALLING A DOOR

(71) Applicant: Masonite Corporation, Tampa, FL (US)

(72) Inventors: Timothy D. Gouge, Elgin, IL (US); Jan Ettrich, Geneva, IL (US)

(73) Assignee: Masonite Corporation, Tampa, FL (US)

( * ) Notice: Subject to any disclaimer, the term of this patent is extended or adjusted under 35 U.S.C. 154(b) by 0 days.

(21) Appl. No.: 14/813,356

(22) Filed: Jul. 30, 2015

(65) Prior Publication Data

US 2015/0376924 A1 Dec. 31, 2015

Related U.S. Application Data

(62) Division of application No. 14/244,051, filed on Apr. 3, 2014, now Pat. No. 9,309,704.

(60) Provisional application No. 61/808,002, filed on Apr. 3, 2013.

(51) Int. Cl.

| | |
|---|---|
| ***E04B 1/00*** | (2006.01) |
| ***E05D 3/02*** | (2006.01) |
| ***E05D 5/14*** | (2006.01) |
| ***E05D 11/00*** | (2006.01) |
| ***E05D 7/10*** | (2006.01) |

(52) U.S. Cl.

CPC . *E05D 3/02* (2013.01); *E05D 5/14* (2013.01); *E05D 7/1044* (2013.01); *E05D 11/0009* (2013.01); *Y10T 16/52* (2015.01); *Y10T 29/49815* (2015.01)

(58) Field of Classification Search

CPC ..... E05D 7/1044; E05D 11/0009; E05D 5/14; E05D 3/02; E05D 2003/00; E05D 2005/02; Y10T 29/49815; Y10T 16/52; E04F 21/0007; E04D 5/02; E04D 5/04

See application file for complete search history.

(56) References Cited

U.S. PATENT DOCUMENTS

| | | | | |
|---|---|---|---|---|
| 743,279 | A | 11/1903 | Haycock | |
| 1,388,223 | A | 8/1921 | Wakefield | |
| 2,023,249 | A * | 12/1935 | Soss | E05D 3/02 16/251 |
| 2,561,619 | A | 7/1951 | Giannini | |
| 2,748,420 | A | 6/1952 | Clover | |
| 2,729,895 | A | 1/1956 | Backstrom | |

(Continued)

OTHER PUBLICATIONS

Replacing an Interior Door, Joseph Truini, This Old House Magazine, Mar. 21, 2008, http://www.thisoldhouse.com/toh/how-to/step/0,,579371,00.html.*

*Primary Examiner* — Brian Mattei
*Assistant Examiner* — Gisele Ford
(74) *Attorney, Agent, or Firm* — Berenato & White, LLC

(57) ABSTRACT

A method of installing a door is provided. According to an embodiment, an outgoing hinge is detached and removed from an attachment location on a side of an outgoing door. A replacement hinge is positioned at the attachment location on the first door where the outgoing hinge was attached. While the replacement hinge is positioned at the attachment location, an alignment position removably coupled to the replacement hinge is folded at an edge of the side of the outgoing door to form a crease in the alignment protrusion. The replacement hinge is positioned on a side of a replacement door with the alignment protrusion aligned with and folded over an edge of the side of the replacement door, and the replacement hinge is attached to the side of the replacement door.

15 Claims, 8 Drawing Sheets

(56) References Cited

U.S. PATENT DOCUMENTS

| | | | |
|---|---|---|---|
| 2,885,722 | A | 5/1959 | Halliday |
| 2,978,736 | A | 4/1961 | Welker |
| 2,987,087 | A | 6/1961 | Norman et al. |
| 3,015,126 | A | 1/1962 | Ahlgren |
| 3,431,591 | A | 3/1969 | Betso |
| 3,629,900 | A | 12/1971 | Beerli, Jr. |
| 3,869,752 | A | 3/1975 | Klay |
| 3,999,246 | A | 12/1976 | Suska |
| 4,143,443 | A | 3/1979 | Reyle |
| 4,475,266 | A | 10/1984 | Suska |
| 4,675,940 | A | 6/1987 | Brockhaus |
| 4,864,688 | A | 9/1989 | Gerber |
| 5,007,134 | A | 4/1991 | Stanford |
| 5,033,161 | A | 7/1991 | Chavez |
| 5,542,153 | A | 8/1996 | Ramsby et al. |
| 5,561,886 | A | 10/1996 | Flamme |
| 5,819,372 | A | 10/1998 | Magoon |
| 5,956,809 | A | 9/1999 | Hodgson |
| 6,286,185 | B1 | 9/2001 | Ramsauer |
| 6,721,994 | B2 | 4/2004 | Bowman et al. |
| 7,162,774 | B1 | 1/2007 | Von Resch et al. |
| 7,603,746 | B1 | 10/2009 | von Resch et al. |
| 8,099,834 | B2 | 1/2012 | Corso et al. |
| 8,656,558 | B2 | 2/2014 | Van Gennep |
| 2005/0278962 | A1 | 12/2005 | Klonowski, III |
| 2006/0156512 | A1 | 7/2006 | Naylor |
| 2008/0276418 | A1* | 11/2008 | Peters ..... E05D 11/0027 16/221 |
| 2009/0056075 | A1 | 3/2009 | Green et al. |
| 2010/0242227 | A1 | 9/2010 | Tagtow et al. |
| 2013/0104341 | A1 | 5/2013 | Kenerly et al. |

* cited by examiner

METHODS OF INSTALLING A DOOR

This application is a division of application Ser. No. 14/244,051, filed on Apr. 3, 2014, now U.S. Pat. No. 9,309,704, which claims priority to provisional application Ser. No. 61/808,002, filed on Apr. 3, 2013, the disclosures of which are incorporated herein by reference and to which priority is claimed.

FIELD OF THE INVENTION

This invention relates to a hinge kit which may be used to simplify door installation and/or door replacement, and related methods, including methods of installing and replacing a door.

BACKGROUND

A door can be coupled to a door frame using hinges. Generally, due to the difficulty in achieving vertical and angular alignment of the door within the frame, doors are frequently pre-hung within the frame at a factory prior to purchase and installation. However, it may be inconvenient to replace the door frame every time a new door is needed.

SUMMARY OF THE INVENTION

An aspect of the invention provides a hinge kit. The hinge kit can comprise a first hinge and a second hinge. The first hinge can include a first plate having a first knuckle coupled to the first plate and a second knuckle spaced from the first plate. The first hinge can further include a second plate having a first knuckle and a second knuckle coupled to the second plate and a third knuckle spaced from the second plate. A first pin can be fixedly coupled to the first hinge. The second hinge can include a first plate having a first knuckle and a second knuckle coupled to the first plate and a second plate having a first knuckle and a second knuckle coupled to the second plate. The second hinge can further include a second pin removably coupled to the second hinge.

Another aspect of the invention provides a hinge. The hinge can comprise a first plate having a first knuckle and a second knuckle and a second plate having a first knuckle and a second knuckle. The hinge can further comprise an alignment protrusion removably coupled to the second plate of the hinge. The alignment protrusion can be configured to deform based on a door to be removed during installation of a replacement door. A pin can be axially aligned within the first knuckle and the second knuckle of the first plate and the first knuckle and the second knuckle of the second plate of the hinge.

Yet another aspect of the invention provides a method of installing a door. The method can include removing a first door comprising a first hinge and a second hinge from a door frame. The first hinge and the second hinge can remain attached to the first door after removal from the door frame. The first door can be aligned with a second door such that a top surface of the first door and a top surface of the second door are flush. The first hinge and the second hinge of the first door can extend toward the second door. A first mark can be provided on the second door in a location associated with the first hinge and a second mark can be provided on the second door in a location associated with the second hinge. A third hinge can be aligned with the first mark and a fourth hinge can be aligned with the second mark. The third hinge can comprise an alignment protrusion configured to be deformed based on the first door and the fourth hinge can comprise an alignment protrusion configured to be deformed based on the first door. The alignment protrusion of the third hinge can be coupled to the second door and the alignment protrusion of the fourth hinge can be coupled to the second door. The third hinge and the fourth hinge can be attached to the door using fasteners. The alignment protrusion of the third hinge and the alignment protrusion of the fourth hinge can be removed after the third hinge and the fourth hinge are attached to the second door. The second door can be hung within the door frame. A first pin can be associated with the third hinge and a second pin can be associated with the fourth hinge.

According to an aspect of the invention, a hinge kit is provided which includes a first hinge having a permanent, fixed pin and a second hinge having a removable pin.

Another aspect of the invention provides a hinge kit including hinge plates with backset tabs for facilitating placement and alignment of the hinge plates.

A further aspect of the invention provides a hinge kit for simplifying door installation and replacement.

Another aspect of the invention provides methods for installing and replacing doors.

Other aspects of the invention, including apparatus, devices, systems, kits, assemblies, methods, processes, and the like which constitute part of the invention, will become more apparent upon reading the following detailed description of the exemplary embodiments.

BRIEF DESCRIPTION OF THE DRAWING(S)

The accompanying drawings are incorporated in and constitute a part of the specification. The drawings, together with the general description given above and the detailed description of the exemplary embodiments and methods given below, serve to explain the principles of the invention. In such drawings.

DETAILED DESCRIPTION OF THE EXEMPLARY EMBODIMENTS AND EXEMPLARY METHODS

Figure 1:
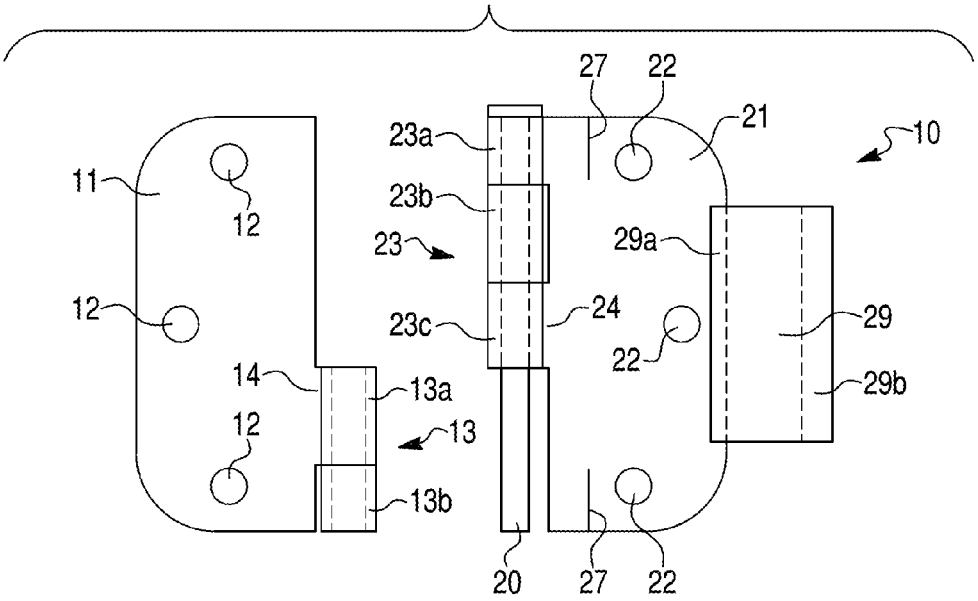
FIG. 1 is a front elevational assembly view of a supporting hinge assembly in a disassembled state according to an embodiment of the invention.

Reference will now be made in detail to exemplary embodiments and methods of the invention. It should be noted, however, that the invention in its broader aspects is not necessarily limited to the specific details, representative materials and methods, and illustrative examples shown and described in connection with the exemplary embodiments and methods.

A hinge kit according to an embodiment of the present invention is best illustrated in FIGS. 1-4. The hinge kit includes a supporting hinge generally designated by reference numeral 10 in FIG. 1 and a universal hinge generally designated by reference numeral 30 in FIG. 2. In an exemplary embodiment, the hinge kit includes one supporting hinge 10 as the uppermost or top hinge of the hinge kit and one, two, or more universal hinges 30 located vertically below the supporting hinge 10. Typically, the hinge kit will include one supporting hinge 10 and two universal hinges 30 per door.

The supporting hinge 10 includes a frame side hinge plate 11 and a door side hinge plate 21. The frame side hinge plate 11 has mounting holes 12 for receiving screws or other fasteners to mount the frame side hinge plate 11 to a door frame/jamb. Likewise, the door side hinge plate 21 has mounting holes 22 for receiving screws or other fasteners to mount the door side hinge plate 21 to a stile of a door, frequently in a pocket formed in the stile. It should be understood that hinge plates 11 and 21 may be substituted for one another, such that the hinge plate 11 is mounted to the door and the hinge plate 21 is mounted to the door frame/jamb.

The frame side hinge plate 11 includes a knuckle 13 having a plurality of discrete knuckle portions, shown in FIG. 1 as upper and lower knuckle portions 13*a*, 13*b* immediately adjacent to one another in vertically stacked relationship. As best shown in FIG. 1, the upper knuckle portion 13*a* is connected to an edge of the frame side hinge plate 11 by a stem 14, whereas the lower knuckle portion 13*b* is spaced from the edge of the frame side hinge plate 11. The lower knuckle portion 13*b* is welded or otherwise secured to the upper knuckle portion 13*a*. Alternatively, the upper and lower knuckle portions 13*a*, 13*b* may be a unitary tubular piece with a demarcation line to give the appearance that the knuckle 13 is composed of two or more discrete knuckle portions 13*a*, 13*b*. The knuckle portions 13*a*, 13*b* have through-holes that align with one another for receiving a pin 20, as described in further detail below.

The door side hinge plate 21 includes a knuckle 23 having the appearance of a plurality of discrete knuckle portions, shown in FIG. 1 as upper, middle, and lower knuckle portions 23*a*, 23*b*, and 23*c* immediately adjacent one another in a vertically stacked relationship. As best shown in FIG. 1, the upper knuckle portion 23*a* and lower knuckle portion 23*c* are connected to the edge of the door side hinge plate 21 by stems 24, whereas the middle knuckle portion 23*b* is spaced from the edge of the door side hinge plate 21. The middle knuckle portion 23*b* is welded or otherwise secured to the upper knuckle portion 23*a* and the lower knuckle portion 23*c*. Alternatively, the knuckle portions 23*a*, 23*b*, and 23*c* may be a unitary tubular piece with demarcation lines to give the appearance that the knuckle 23 is composed of two or more discrete knuckle portions 23*a*, 23*b*, and 23*c*. The knuckle portions 23*a*, 23*b*, and 23*c* have through-holes that align with one another and with the axially aligned knuckle portions 13*a*, 13*b* for receiving the pin 20.

An upper portion of the pin 20 is fixed in the knuckle 23 of the door side hinge plate 21. An adhesive, a press fit condition, and/or a fastener may be used to permanently fix the upper portion of the pin 20 relative to the knuckle 23. In the disassembled state shown in FIG. 1, a lower portion of the pin 20 extends from the lower knuckle portion 23*c*. In an assembled state, the lower portion of the pin 20 is received in and aligned with through-holes of the knuckle 13, such that knuckle 23 is seated on the knuckle 13. As an alternative, the pin 20 may be fixed in the knuckle 13 of the frame side hinge plate 11 and slidingly received by the knuckle 23 of the door side hinge plate 21.

The knuckle portions 13*b* and 23*b* are referred to herein as false knuckle portions. In the assembled state, the knuckle portions 23*a*, 23*b*, 23*c*, 13*a*, and 13*b* appear to alternatingly intermesh with one another. That is, the alternating knuckle portions 23*a*, 23*c*, and 13*b* have the appearance of being connected to the door side hinge plate 21, and the alternating knuckle portions 23*b* and 13*a* have the appearance of being connected to the frame side hinge plate 11. As described above, in actuality the knuckle 23 of the door side hinge plate 21 sits on the knuckle 13 of the frame side hinge plate 11, with the pin 20 received through the aligned knuckles 13, 23.

Figure 2:
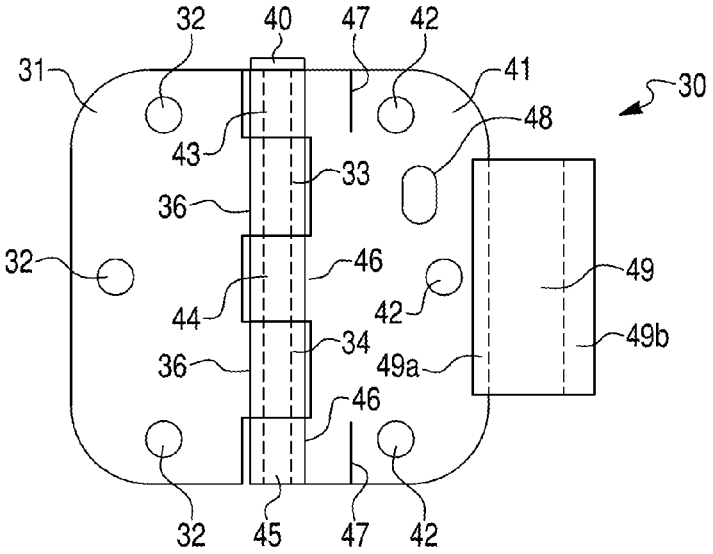
FIG. 2 is a front elevational view a universal hinge in an assembled state according to an embodiment of the invention.
Figure 3:
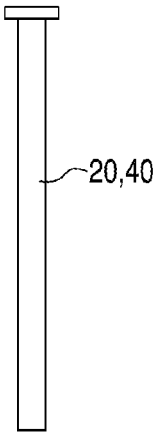
FIG. 3 is a front elevational view of a pin suitable for use with the supporting hinge of FIG. 1 and the universal hinge of FIG. 2.

The universal hinge 30 is best shown in FIG. 2. The universal hinge 30 includes a frame side hinge plate 31 and a door side hinge plate 41. The frame side hinge plate 31 has mounting holes 32 for receiving screws or other fasteners to mount the frame side hinge plate 31 to a door frame/jamb. Likewise, the door side hinge plate 41 has mounting holes 42 for receiving screws or other fasteners to mount the door side hinge plate 41 to the stile of a door, frequently in a pocket formed into the stile. It should be understood that hinge plates 31 and 41 may be substituted for one another, such that the hinge plate 31 is mounted to the door and the hinge plate 41 is mounted to the door frame/jamb.

The frame side hinge plate 31 of the universal hinge 30 includes discrete knuckles 33, 34 spaced apart from one another. The knuckles 33, 34 are both connected to the edge of the frame side hinge plate 31 by stems 36. The knuckles 33, 34 have through-holes aligned with one another for receiving a pin 40.

The door side hinge plate 41 of the universal hinge 30 includes discrete knuckles 43, 44, and 45 spaced from one another. The knuckles 43, 44, and 45 are connected to the edge of the door side hinge plate 41 by stems 46. The knuckles 33 and 34 alternatingly intermesh with the corresponding through-holes of knuckles 43, 44, and 45. The knuckles 43, 44, and 45 have through-holes aligned with one another and aligned with the knuckles 33, 34 of the frame side hinge plate 31 for receiving the pin 40. The pins 20 and 40 may be identical to one another, except that the pin 40 of the universal hinge 30 is not permanently fixed in place to the hinge.

The supporting hinge 10 further includes a sight line 27 on the face of the door side hinge plate 21. Similarly, the universal hinge 30 includes a sight line 47 on the face of the door side hinge plate 41. The sight lines 27 and 47 are parallel and spaced from edges of the door side hinge plates 21 and 41, respectively. In an exemplary embodiment, sight lines 27 and/or 47 are alignment indicators such that the sight lines 27 and/or 47 can be aligned with the edge of a new door during installation of that door. The sight lines 27 and 47 can be provided on the hinge plates 21 and 41, respectively, using various methods. For example, sight lines 27 and 47 can be etched, scribed or printed on the surface of the hinge plates 21 and 41, or sight lines 27 and 47 can be formed separately, such as a label, and then adhered to the surface of the hinge plates 21 and 41.

The door side hinge plate 41 also includes an adjustment slot 48 extending vertically. The adjustment slot 48 is elongated so as to have a length longer than its width. During assembly, a screw or other mechanical fastener can be placed in the adjustment slot 48 to loosely mount the door side hinge plate 41 to a door while allowing for vertical adjustment of the door side hinge plate 41 for ensuring proper alignment.

The door side hinge plates 21 and 41 each include an alignment protrusion, such as backset tabs 29 and 49, respectively. The backset tabs 29, 49 may be made of any material configured to maintain a shape after being deformed or creased, such as cardboard, paperboard or other material that may be creased, and is suitable to performing the function of establishing a backset gap. The backset tabs 29, 49 include first adhesive strips 29*a*, 49*a* for temporarily attaching the backset tabs 29, 49 to the door side hinge plates 21, 41, respectively. The backset tabs 29, 49 are also provided with second adhesive strips 29*b*, 49*b* covered by a removable/peelable backing for temporarily attaching the door side hinge plates 21 and 41 to the replacement door during installment, as described below. During assembly, the door side hinge plates 21, 41 are placed onto an outgoing or "old" door so that the mount holes 22, 42 align with the holes in the existing screw holes in the outgoing door. The backset tabs 29, 49 are folded over the edge of the side of the outgoing door to crease the backset tab material and thus create a backset gap where the backset gap is the space defined between the backset tab and the hinge plates 21, 41 that is created when the backset tabs 29, 49 are deformed over the edge of the side of the outgoing door. The peel-away backings of the adhesive strips 29*b*, 49*b* may then be removed, and the door side hinge plates 21, 41 with the creased tabs 29, 49 placed onto the replacement (new) door to align the crease with the edge of the replacement door. The adhesive temporarily holds the door side hinge plates 21, 41 in place on the replacement door as screws are used to attach the door side hinge plates 21, 41 to the replacement door. In an exemplary embodiment, the backset tabs 29, 49 can be formed separately from the hinge plates 21, 41 and then be removably coupled to hinge plates 21, 41. For example, hinge plates 21, 41 can include an indication on where backset tabs 29, 49 can be removably coupled to the surface of the hinge plates 21, 41 such as in a position in alignment with mounting holes 22. The backset tabs 29, 49 can be removably coupled using various techniques such as removable or non-permanent adhesives, etc.

Figure 4:
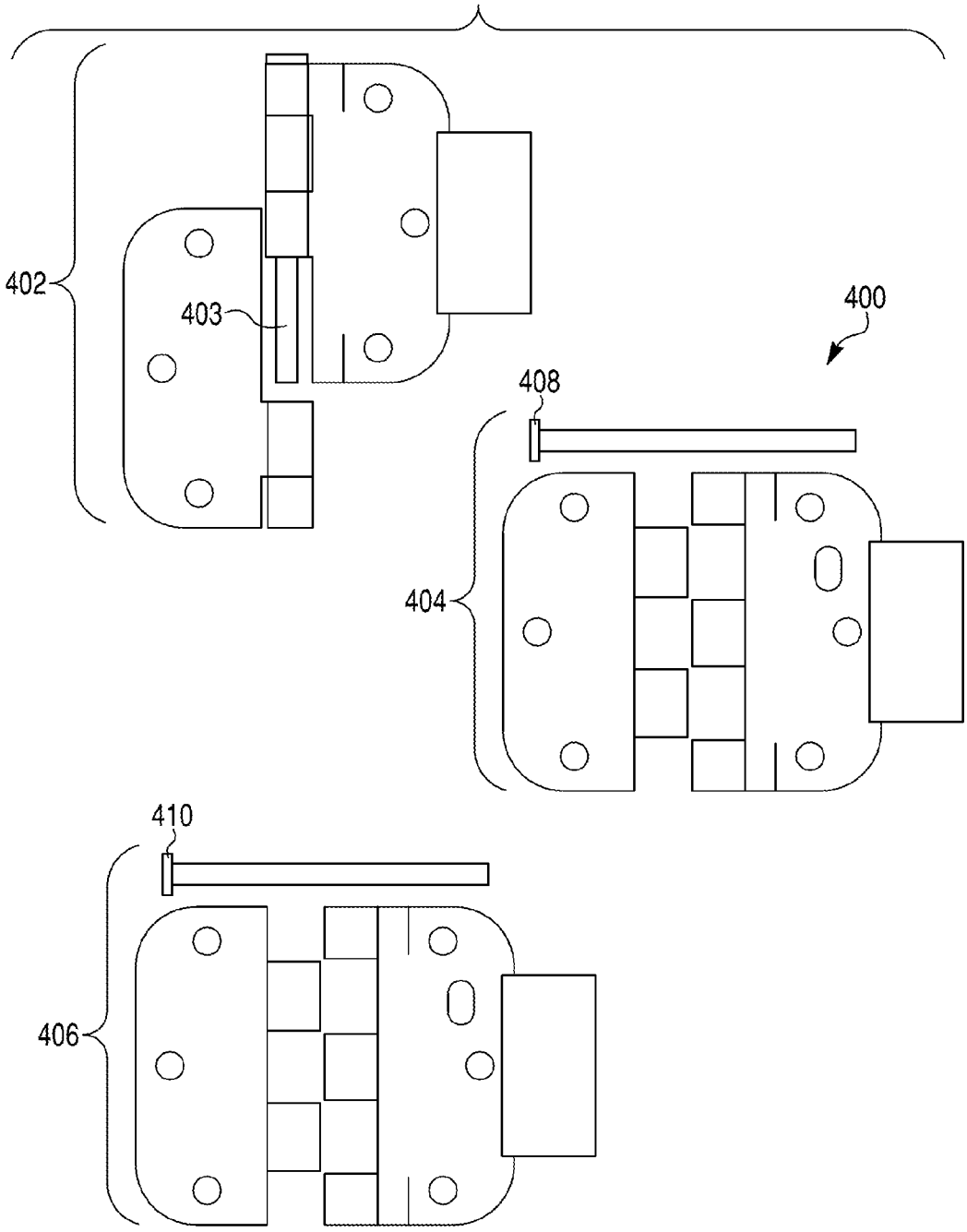
FIG. 4 is front elevational view of a hinge kit according to an embodiment of the invention.

The hinge kit according to an exemplary embodiment of the invention is best shown in FIG. 4. The hinge kit 400 can include a supporting hinge 402 and universal hinges 404, 406. The supporting hinge 402 can include a pin 403 fixedly coupled to the supporting hinge 402 to be installed in a top location with respect to a door. Universal hinges 404, 406 can include a removable pin 408, 410 respectively to be installed in a middle (or central) and/or a bottom position with respect to the door. Any number of hinges can be included in hinge kit 400 provided that one hinge is a supporting hinge 402 and one hinge is a universal hinge 404, 406. Supporting hinge 402 is different from universal hinges 404, 406 and universal hinges 404, 406 can be identical to one another.

Figure 5:
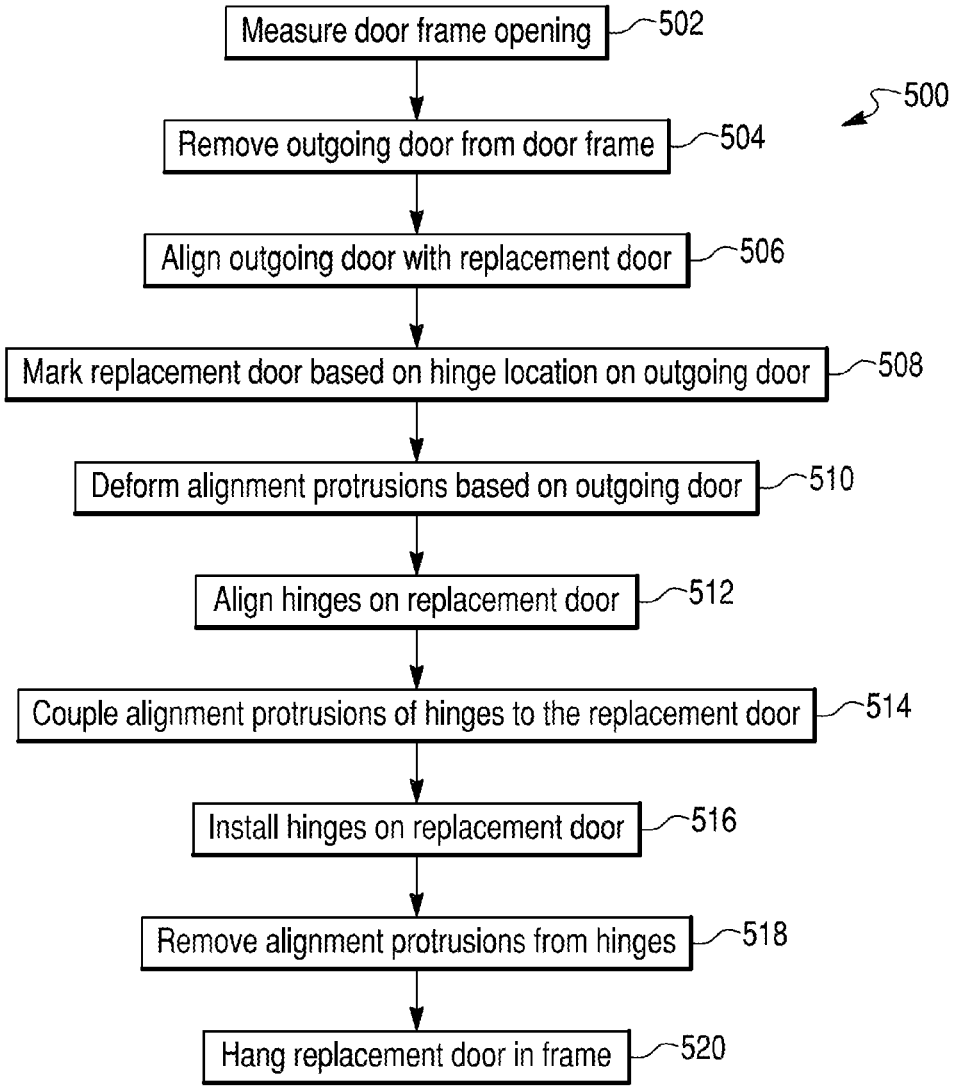
FIG. 5 is a flow chart of an exemplary method of installing a replacement door according to an embodiment of the invention.

FIG. 5 is a flow chart illustrating an exemplary method of installing a door into an existing door frame according to the present invention. Installation may be performed, for example, using various instruments such as a screw driver, a ruler or measuring tape, and a pencil or pen.

The method will be discussed with reference to the exemplary supporting hinge 10 and universal hinge 30, as well as hinge kit 400 illustrated in FIGS. 1-4. However, the method can be implemented with any suitable installation device for a door. In addition, although FIG. 5 depicts steps performed in a particular order for purposes of illustration and discussion, the methods discussed herein are not limited to any particular order or arrangement. One skilled in the art, using the disclosures provided herein, will appreciate that various steps of the methods can be omitted, rearranged, combined and/or adapted in various ways.

At 502, a width and height of a door opening of a door frame are measured. For example, a measuring instrument such as a measuring tape, ruler, or comparable device can be used to measure the width and height of a replacement door to determine whether the replacement door will fit into the opening of the door frame. In an exemplary embodiment, the width of the opening in the door frame should be at least about 0.8 cm (5/16 inch) larger than the width of the replacement door.

The door to be replaced is removed from the door frame at 504. For example, the existing hinges of the outgoing door are removed from the frame using a power or manual screwdriver while leaving the existing hinges attached to the side of the outgoing door.

Figure 6:
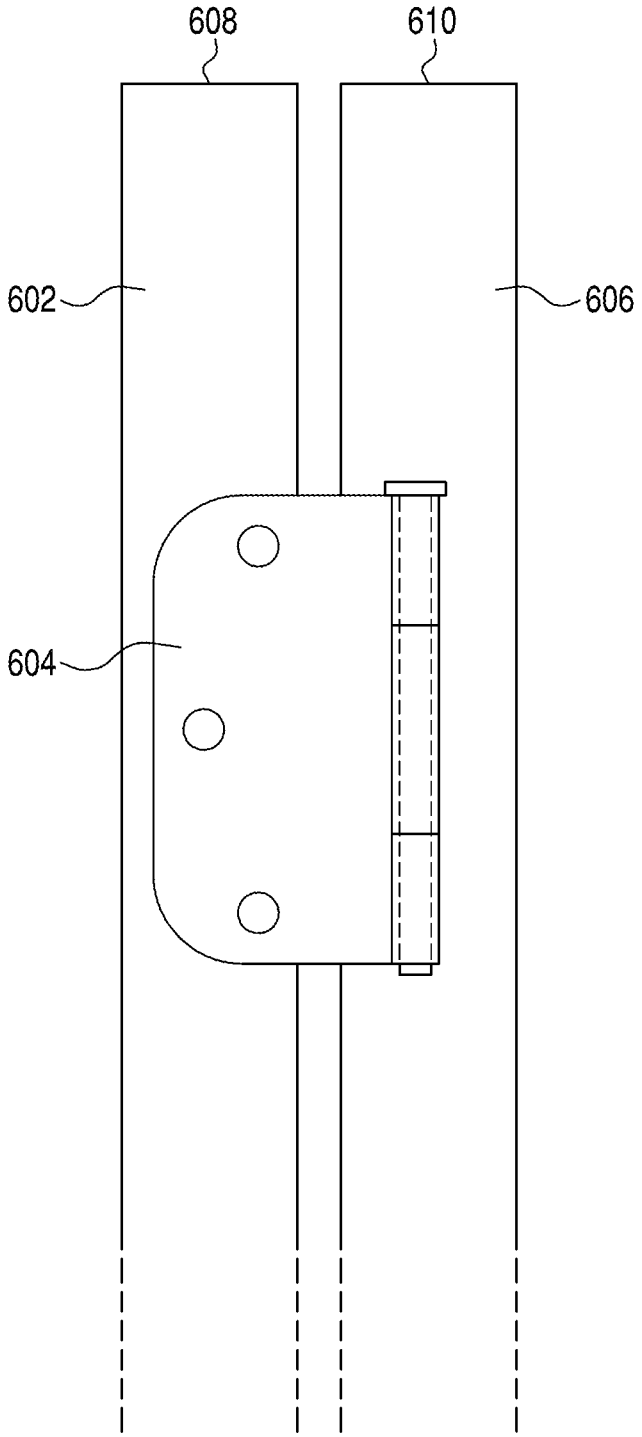
FIG. 6 is a fragmentary elevational view of during installation of a door into an existing door frame in accordance with an embodied method of the invention.

At 506, the outgoing door is aligned with the replacement door. For example, as illustrated in FIG. 6, the outgoing door 602 including hinge 604, is aligned such that the top surface 608 of outgoing door 602 is parallel to the top surface 610 of the replacement door 606. In an exemplary embodiment, the outgoing door 602 is positioned on its side such that the hinges 604 face upward and the hinge pins face outward. The outgoing door 602 may be leaned against a table or other structure to hold it in place. The replacement door 606 is positioned hinge-side up in side-by-side relationship with the outgoing door 602, with the outgoing and replacement doors facing in the same direction. The outgoing and replacement doors 602, 606 are aligned at their top edges 608, 610, respectively, as best shown in FIG. 6.

Figure 7:
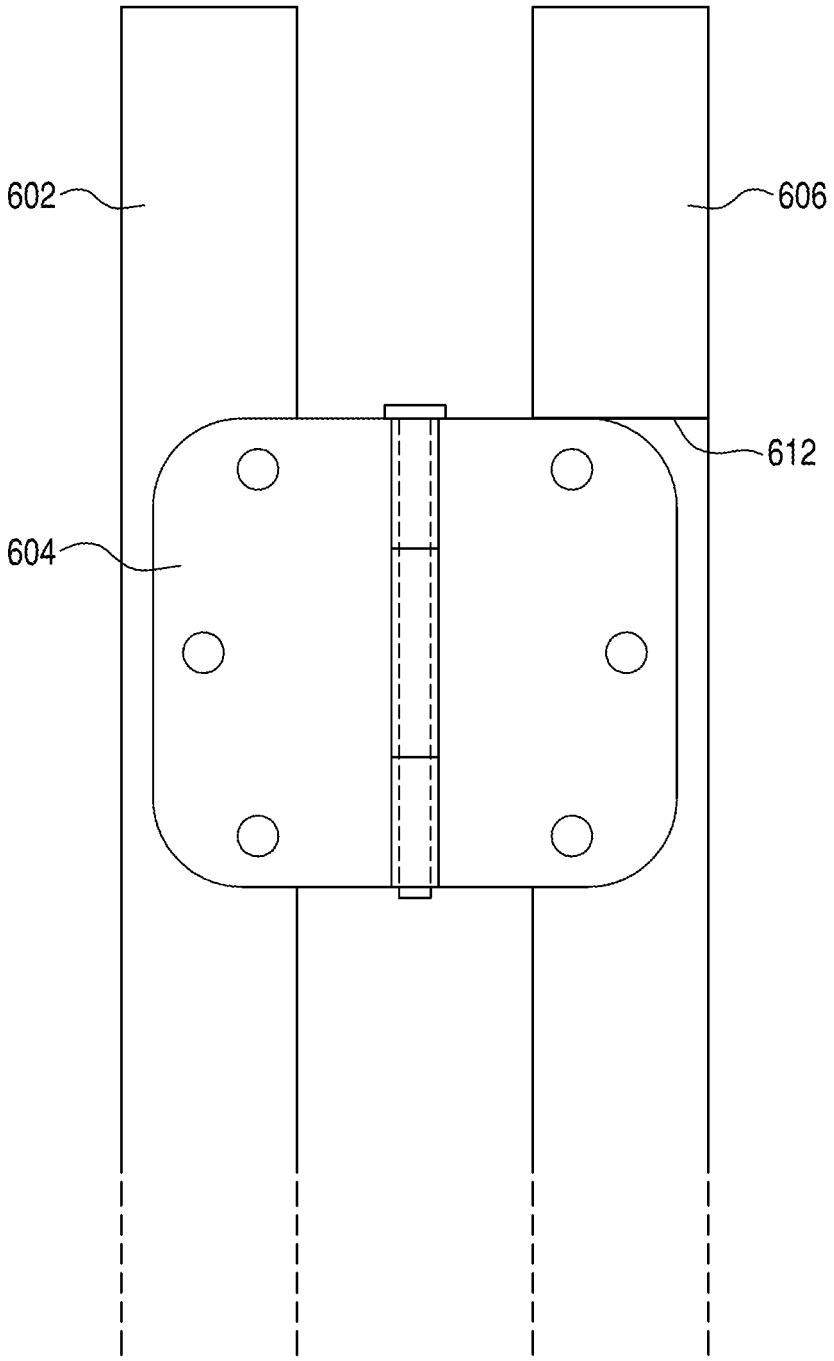
FIG. 7 is a fragmentary elevational view during installation of a door into an existing door frame in accordance with an embodied method of the invention.

A hinge location is marked on the replacement door based on the location of the hinge on the outgoing door at 508. As best shown in FIG. 7, while the doors 602, 606 remain aligned, the existing hinges 604 of the outgoing door are opened and laid across the side of the replacement door 606 (e.g., the portion of the hinge previously coupled to the frame). A mark 612 is applied to the side of the replacement door 606 at the top edge of each existing hinge 604. The mark 612 can be made using various instruments such as a pen, pencil, etc. While only one hinge 604 and one mark 612 are illustrated in FIG. 7, corresponding marks can be applied to replacement door 606 based on the number of hinges originally coupled to the outgoing door 602. After mark 612 is applied to the replacement door 606, hinge 604 can be removed from the outgoing door 602.

The frame side hinge plates of the supporting/top hinge 402 and the universal hinges 404, 406 are mounted into the existing mortise (hinge) pockets of the door frame. The mortise pockets will already exist, having been formed previously when the outgoing door was originally hung on the door frame. It is noted that the hinge kit 400 can also be used where a mortise pocket is omitted from the frame and/or the replacement door. In the event that the previous door did not include hinge pockets, the mounting holes of the frame side hinge plates are aligned with the existing screw holes in the door frame.

Figure 8:
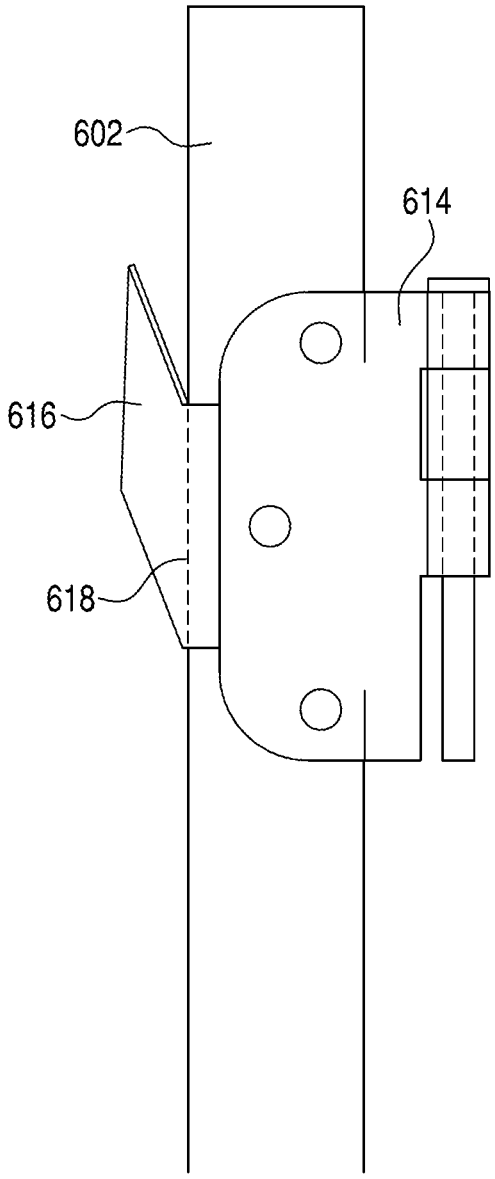
FIG. 8 is a fragmentary elevational view during installation of a door into an existing door frame in accordance with an embodied method of the invention.
Figure 9:
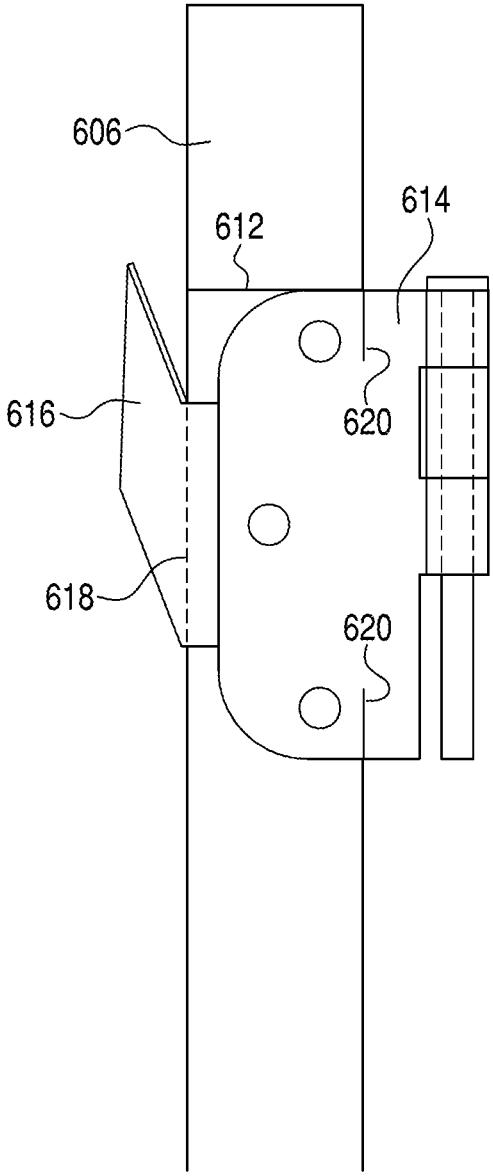
FIG. 9 is a fragmentary elevational view during installation of a door into an existing door frame in accordance with an embodied method of the invention.

At 510, alignment protrusions of a hinge are deformed based on the outgoing door. For example, as best illustrated in FIG. 8, the door side hinge plate of the top/supporting hinge 614 is placed into the top hinge pocket of the outgoing door 602. Alternatively, when no top hinge pocket is present, the mounting holes of the hinge can be aligned with screw holes of the outgoing door previously made by hinge fasteners. The alignment protrusion 616 or backset tab of hinge 614 is folded over the side edge of the outgoing door 602 edge to crease the backset tab at line 618.

The hinge can then be aligned on the replacement door at 512. After the door side hinge plate of hinge 614 with its alignment protrusion 616 creased at line 618 is removed from the outgoing door 602, hinge 614 is aligned and oriented on the replacement door 606. For example, hinge 614 can be aligned such that the top edge of hinge 614 is aligned with mark 612 alignment indicators 620, or sight lines are aligned with a first edge of the replacement door 606, and the crease 618 of the alignment protrusion 616 can be aligned with a second edge of the replacement door 606. The exposed portion of the fixed hinge pin should point towards the bottom of the door.

At 514, the alignment protrusion of the hinge is coupled to the replacement door. For example, an adhesive backing (not shown) can be removed from an adhesive strip formed on the back of the alignment protrusion 616, such that the alignment protrusion 616 can be removably coupled to the replacement door 606 in order to maintain alignment during installation.

The hinge is installed on replacement door at 516. For example, screws can be inserted into the mount holes of the top door side hinge plate to secure it in position. At 518, the alignment protrusions are removed from the hinge. For example, the backset tab may be removed from the door side hinge plate.

While one hinge is discussed above, all of the door side hinge plates such as supporting hinge 402 and universal hinges 404, 406 may be attached to the replacement door 606 in similar fashion. For example, middle and bottom universal hinges can be positioned into the middle and bottom hinge pockets, respectively, of the outgoing door 602 and their respective backset tabs folded over to crease them at the edge of the outgoing door 602. The backing of the second adhesive strip is removed from the backset tabs, the middle and bottom universal hinges are aligned with the marks on the side of the replacement door 606, and the creases are aligned with the side edge of the replacement door. A screw is inserted into the adjustment slot of the door side hinge plate of the middle hinge, but is not tightened initially in order to assist in vertically aligning the replacement door 606 within the door frame. The screw should not be so tight as to prevent the door side hinge plate from moving upwardly and downwardly (as the adjustment slot 48 slides along the screw) with relatively little effort. Although not shown, a screw is similarly inserted in the adjustment slot 48 of the door side hinge plate of the bottom hinge.

Figure 10:
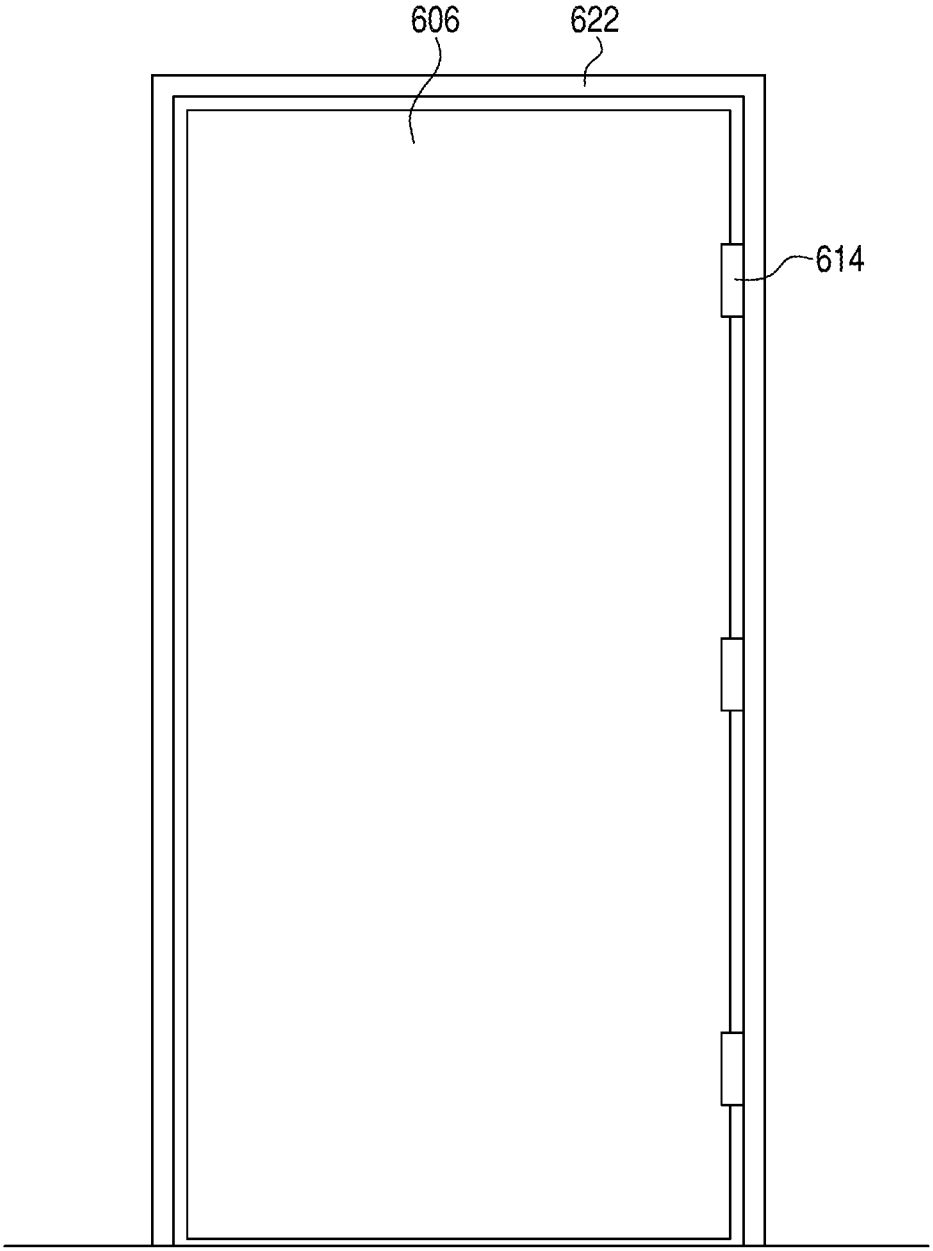
FIG. 10 is an elevational view during installation of a door into an existing door frame in accordance with an embodied method of the invention.

At 518, the alignment protrusions are removed from the hinges. For example, the alignment protrusions are removed after each hinge is installed onto the replacement door. Alternatively, the alignment protrusions can be removed after all of the hinges are installed onto the replacement door. The replacement door is hung in the door frame at 520. For example, as best illustrated in FIG. 10, the replacement door 606 is hung on the door frame 622 by inserting the fixed pin of the top/supporting hinge 614 into the knuckle of the frame side door plate. Once hung, the door may be closed. The door side hinges of the middle and bottom hinges may be shimmed, so that the knuckles of the door side hinges and frame side hinges properly intermesh. The length of the adjustment slots 48 through which the screws are inserted, as described above, allows the door side hinge plates of the middle and lower hinges to be adjusted upwardly or downwardly so that their knuckles are positioned into intermeshing relationship with the knuckles of the frame side hinge plates of the middle and lower hinges, respectively. The door 606 may then be opened, and screws are inserted into the mount holes of the door side hinge plates of the middle and bottom hinges. The screws in the adjustment slots 48 may then be tightened.

Advantageously, exemplary embodiments described herein may reduce or eliminate the need for mortise pockets on door sides and offer the flexibility to accommodate a wide variety of existing door frames. The hinge kit can also simplify door replacement, making it easier for installation of a door, even by a single person without assistance. Once the hinge kit is installed, it provides an easier way to manage the removal and re-installation of doors for future tasks such as painting, refurbishing, moving, etc. by following the installation procedure without the removable backset tabs since they will not be needed or available.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. The specification describes specific examples to accomplish a more general goal that may be accomplished in another way.

What is claimed is:

1. A method of installing a door, comprising the steps of:

removing a first door comprising a first hinge and a second hinge from a door frame, wherein the first hinge and the second hinge remain attached to the first door after removal from the door frame;

aligning the first door with a second door such that a top surface of the first door and a top surface of the second door are flush;

extending the first hinge and the second hinge of the first door toward the second door;

providing a first mark on the second door at a first location associated with the first hinge and providing a second mark on the second door at a second location associated with the second hinge;

aligning a third hinge with the first mark and aligning a fourth hinge with the second mark, wherein the third hinge comprises a first alignment protrusion configured to be deformed based on the first door and the fourth hinge comprises a second alignment protrusion configured to be deformed based on the first door;

coupling the first alignment protrusion of the third hinge to the second door and coupling the second alignment protrusion of the fourth hinge to the second door;

attaching the third hinge and the fourth hinge to the second door using fasteners;

removing the alignment protrusion of the third hinge and the alignment protrusion of the fourth hinge after the third hinge and the fourth hinge are attached to the second door; and hanging the second door within the door frame, wherein a first pin is associated with the third hinge and a second pin is associated with the fourth hinge.

2. The method of claim 1, wherein the first pin is permanently fixedly coupled to the third hinge and the second pin is removably coupled to the fourth hinge.

3. The method of claim 1, further comprising positioning the third hinge in a location associated with the first hinge on the first door such that the first alignment protrusion extends beyond the first door;

deforming the first alignment protrusion of the third hinge by creasing the first alignment protrusion at an edge of the first door.

4. The method of claim 1, further comprising vertically adjusting the second door within the door frame using an adjustment slot of the fourth hinge.

5. A method of installing a door, comprising the steps of:

aligning a first door having a first top surface with a second door having a second top surface to set the first and second top surfaces flush with one another, the first door comprising a first hinge attached to a side of the first door after removal of the first door from a door frame;

while the first and second doors are aligned, marking the second door at a first mark location corresponding to a first attachment location at which the first hinge is attached to the side of the first door;

detaching and removing the first hinge from the side of the first door;

positioning a first replacement hinge at the first attachment location where the first hinge was attached to the side of the first door, the first replacement hinge comprising a first alignment protrusion;

while the first replacement hinge is positioned at the first attachment location, folding the first alignment protrusion at an edge of the side of the first door to form a first crease in the first alignment protrusion;

repositioning the first replacement hinge on a side of the second door in alignment with the first mark location and with the first crease of the first alignment protrusion folded over an edge of the side of the second door; and attaching the repositioned first replacement hinge to the side of the second door.

6. The method of claim 5, wherein said marking of the second door comprises:

laying a frame hinge plate of the first hinge across the side of the second door and marking the first mark location on the side of the second door at the top edge of the frame hinge plate of the first hinge.

7. The method of claim 5, wherein the first alignment protrusion comprises a backset tab.

8. The method of claim 5, wherein the first alignment protrusion comprises an adhesive strip and a peelable backing, wherein the method further comprises removing the backing to expose the adhesive strip and coupling the first alignment protrusion to the second door when the first crease of the first alignment protrusion is folded over the edge of the side of the second door.

9. The method of claim 8, further comprising the step of removing the first alignment protrusion from the first replacement hinge and the second door subsequent to said attaching of the first replacement hinge to the side of the second door.

10. The method of claim 5, further comprising the step of:

subsequent to said attaching of the repositioned first replacement hinge to the side of the second door, hanging the second door from the door frame from which the first door was removed.

11. The method of claim 5, wherein:

said attaching step comprises inserting at least one screw through an adjustment slot of a hinge place of the first replacement hinge into the side of the second door, the screw being in an untightened state in the adjustment slot; and the method further comprises, subsequent to said attaching of the repositioned first replacement hinge to the side of the second door, hanging the second door in the door frame from which the first door was removed and subsequently tightening the screw in the adjustment slot.

12. The method of claim 5, further comprising the steps of:

while the first and second doors are aligned, marking the second door at a second mark location corresponding to a second attachment location at which a second hinge is attached to the side of the first door;

detaching and removing the second hinge from the side of the first door;

positioning a second replacement hinge at the second attachment location where the second hinge was attached to the side of the first door, the second replacement hinge comprising a second alignment protrusion;

while the second replacement hinge is positioned at the second attachment location, folding the second alignment protrusion at the edge of the side of the first door to form a second crease in the second alignment protrusion;

repositioning the second replacement hinge on the side of the second door in alignment with the second mark location and with the second crease of the second alignment protrusion folded over the edge of the side of the second door; and attaching the repositioned second replacement hinge to the side of the second door.

13. A method of installing a door, comprising the steps of:

detaching and removing an outgoing hinge from an attachment location on a side of an outgoing door;

positioning a replacement hinge at the attachment location of the outgoing door;

while the replacement hinge is positioned at the attachment location, folding an alignment protrusion removably coupled to the replacement hinge at an edge of the side of the outgoing door to form a crease in the alignment protrusion;

positioning the replacement hinge on a side of a replacement door with the crease of the alignment protrusion folded over an edge of the side of the replacement door; and attaching the positioned replacement hinge to the side of the replacement door.

14. The method of claim 13, further comprising the step of removing the alignment protrusion from the replacement hinge subsequent to said positioning of the replacement hinge on the side of the replacement door.

15. The method of claim 13, wherein the alignment protrusion comprises adhesive that permits the alignment protrusion to be removably coupled to the replacement hinge.

* * * * *